United States Patent [19]

Acero et al.

[11] 4,224,131

[45] Sep. 23, 1980

[54] VENTILATED ELECTROPLATING TANK

[76] Inventors: Steve A. Acero, 21089 Lavina Ct., Cupertino, Calif. 95014; Edward L. Rougeau, 2592 Glade, Santa Clara, Calif. 95051

[21] Appl. No.: 73,216

[22] Filed: Sep. 7, 1979

[51] Int. Cl.[2] ..... C25C 7/00; C25C 7/06

[52] U.S. Cl. ..... 204/274; 204/278; 204/242; 204/DIG. 1

[58] Field of Search ..... 204/275-278, 204/DIG. 1, 242, 274

[56] References Cited

U.S. PATENT DOCUMENTS

| | | | |
|---|---|---|---|
| 1,801,011 | 4/1931 | Koeppen | 204/278 |
| 4,075,069 | 2/1978 | Shinohara et al. | 204/278 X |
| 4,081,347 | 3/1978 | Becker | 204/278 X |
| 4,171,255 | 10/1979 | Tuznik et al. | 204/278 X |

FOREIGN PATENT DOCUMENTS

| | | | |
|---|---|---|---|
| 908089 | 6/1954 | Fed. Rep. of Germany | 204/278 |
| 2704470 | 9/1978 | Fed. Rep. of Germany | 204/278 |
| 190752 | 6/1967 | U.S.S.R. | 204/DIG. 1 |

*Primary Examiner*—John H. Mack
*Assistant Examiner*—D. R. Valentine
*Attorney, Agent, or Firm*—Claude A. S. Hamrick

[57] ABSTRACT

A reinforced polypropylene tank for containing caustic fluids and acid baths used in the electroplating process and having a positive ventilation hood for protecting workers from harmful fumes, vapors, and acid splash and nearby hardware from corrosion is disclosed. An optional hot water heater configuration is also disclosed for heating fluid in the tank and reducing the danger of fire.

12 Claims, 6 Drawing Figures

VENTILATED ELECTROPLATING TANK

BACKGROUND OF THE INVENTION

1. Field of the Invention

The present invention relates generally to fluid containers and more particularly to an electroplating tank or the like for containing caustic and acid solutions, such tank including a novel hood arrangement for aiding ventilation and for reducing acid splash.

2. Description of the Prior Art

In the electroplating industry, tanks containing hundreds of gallons of fluids such as sulfuric acid, hydrogen fluoride and other caustic chemicals are in common use. Hazards associated with the use of such devices are that the fluids often corrode tank materials causing leaks in the tank or failure of the weakened tank due to its inability to withstand the pressures of the heavy fluids.

Another danger is that fumes from a tank may injure the lungs or eyes, or otherwise harm the health of persons using the tank. Fumes and vapor from the tank may also cause corrosion of nearby equipment.

The possibility of fire is another hazard that must be dealt with in electroplating operations. The source of most fires is the electric heater typically used to heat fluids in the tanks. These heaters typically consist of an electric heating element encased in a cylinder which extends down into the fluid. If the fluid level in a tank should drop below the hot part of the heater cylinder, or if the cylinder should be damaged by corrosion, the resulting heat developed can ignite the acid gas mixed with air and cause a fire.

Due to the nature of the operation, common practice today is to operate open top electroplating tanks. In some electroplating processes fluid in the tank is agitated by gas bubbles forced out of holes in pipes resting on the floor of the tank. This bubbling action plus splash caused when articles are loaded or unloaded to/from the tank can result in acid getting on the clothes and exposed parts of the body of persons using the tank. The bubbling action also increases the fumes and vapor coming off the acid.

Typically, ventilation outlets are located in a wall on the side opposite that in which the tank is loaded/unloaded in order to draw the fumes away from persons operating the tank. However, because the fumes and vapors are heavy, this arrangement usually fails to provide adequate removal and a dangerous amount of gas fumes escapes the ventilator, particularly on the side of the tank opposite the ventilator inlet where the draw is weakest.

SUMMARY OF THE PRESENT INVENTION

It is therefore an object of the present invention to provide an electroplating tank device constructed of material with exceptional corrosion resistance and structural strength which affords an extra margin of safety against the escape of dangerous fluids from the container.

Another object of the present invention is to provide a tank device of the type described having an exceptionally strong structural design.

Still another object of the present invention is to provide a tank device of the type described having ventilating means which substantially reduces fumes that might otherwise be inhaled by persons working in the vicinity of the tank.

Still another object of the present invention is to provide a tank device of the type described having means for heating fluid in the tank in a way which substantially reduces the danger of fire.

Still another object of the present invention is to provide apparatus for reducing the energy and cost required to ventilate and heat electroplating tanks.

Briefly, a preferred embodiment of the present invention includes a rectangularly configured tank body constructed entirely of a chemically inert plastic material and having vertical and horizontal strengthening ribs made of the same material. Also included is a splash protection and fume removing hood structure forming an integral part of the tank device. Optional features include the provision of an electrical immersion heater, a bubbling mechanism and/or a hot water heating jacket.

An important advantage of the present invention is that it provides a tank structure which is in its entirety fabricated from chemically inert materials.

Another advantage of the present invention is that it has high strength design features capable of withstanding extremely high loading and impact forces.

Still another advantage of the present invention is that it includes means for reducing acid splash and providing positive ventilation of fumes generated by the electroplating operation.

These and other objects and advantages of the present invention will no doubt become apparent to those skilled in the art after reading the following detailed description of the preferred embodiments which are illustrated in the several figures of the drawing.

IN THE DRAWING

Like numbers represent like parts throughout the several views.

DETAILED DESCRIPTION OF THE PREFERRED EMBODIMENTS

Figure 1:
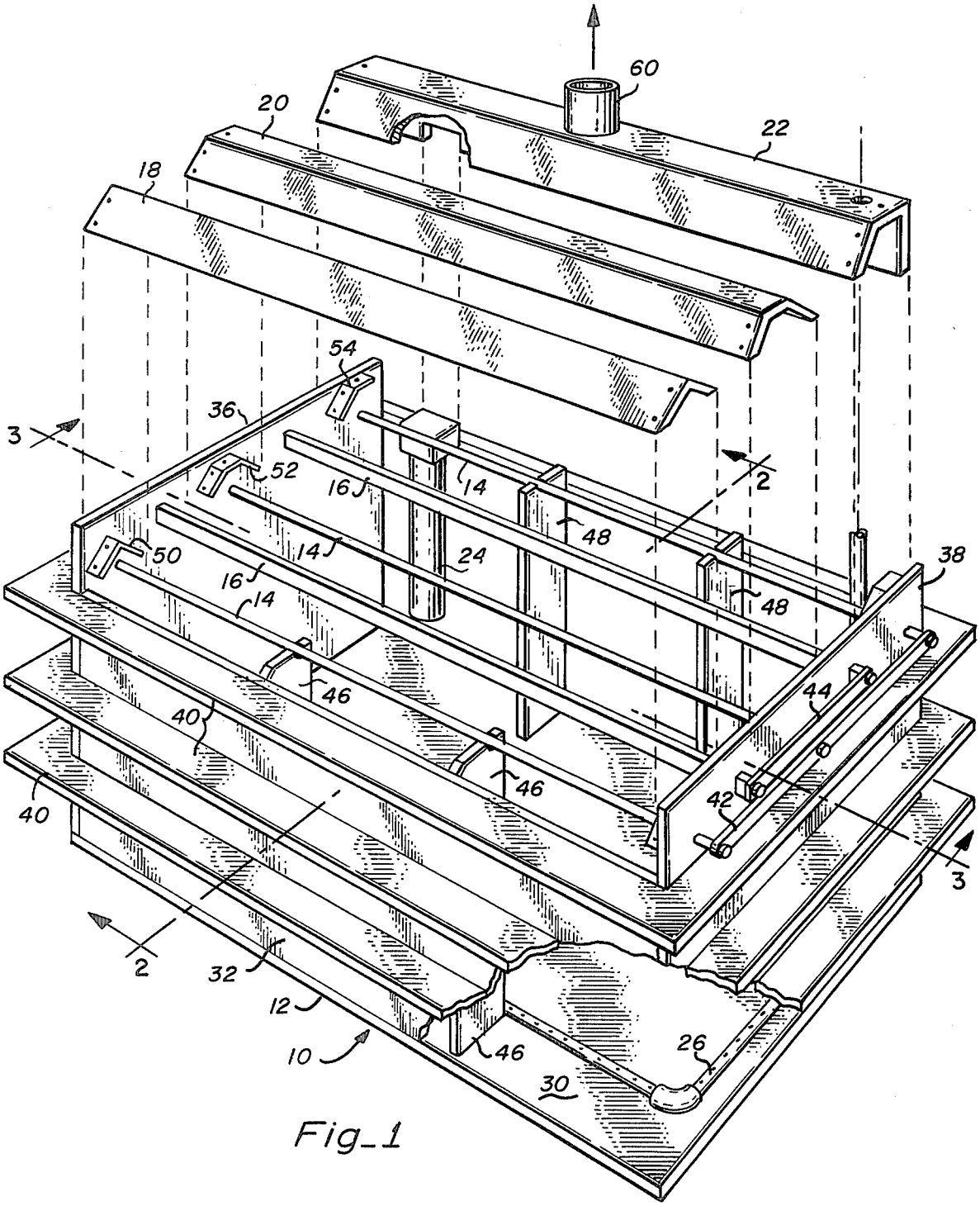
FIG. 1 is a partially broken, exploded perspective view of an electroplating tank device in accordance with the present invention.

Referring now to FIG. 1 of the drawing, there is shown in partially broken exploded perspective view an electroplating tank device 10 in accordance with the present invention. The device 10 includes a tank body 12 having a set of anode rods 14 and a set of cathode bars 16 extending longitudinally relative thereto and through the end walls of the body. In addition, the device is provided with three elongated hood elements 18, 20 and 22 which are mounted upon the body 12 in covering relationship to the anode rods 14.

Also illustrated in FIG. 1 are an immersion-type heater 24 and a bubbling conduit 26 which may be considered as accessory components of the device.

In the preferred embodiment, the tank bottom 30, the side-walls 32 and 34, and the end-walls 36 and 38 are comprised of rectangular sheets. Sheet polypropylene ½" to μ" thick has been found to be an ideal material as it is highly resistant to corrosion, is very strong and is limber enough to resist the cracking of which other corrosion-resistant plastics such as PVC are prone. The sheets of polypropylene are welded together using a technique which makes a joint as strong as the material itself.

Figure 5:
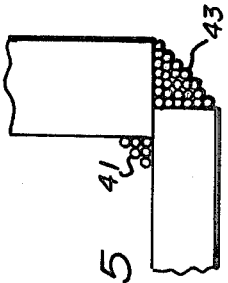
FIG. 5 is a top view showing detail of a joint weld of a corner of the tank shown in FIG. 1.

In accordance with the present invention, an initial heat staking is used to hold the edges of tank sides in position for subsequent welding to strengthen the joint corners. A heat gun blowing hot air (or nitrogen) at roughly 1000° F. across a metal tip, much like the tip of a soldering iron, is used to accomplish the welding operation. This tip, which gets very hot as a result of the hot gases focused on it, is moved across the polypropylene joint, melting the material that it touches. The melted material then flows together and upon cooling forms a tack weld which temporarily bonds the sheets together. The joints are thereafter strengthened by using the heat gun to weld rods of polypropylene along the length of a joint as illustrated in FIG. 5. In the preferred embodiment, six rods 41 are welded on the inside of a corner joint and sixteen rods 43 are successively applied to the outside of a joint. The hot air and hot tip melt the rods together and cause them to adhere to the sheet surfaces. After the outside rods are applied, a router is used to shape them into a quarter-round configuration as illustrated in FIG. 5.

To prevent bowing of the sides and to add structural strength to the tank body, a plurality of griding bands or ribs 40, which completely surround the tank body, are secured to the sides of the tank using the above-described welding technique.

The end walls 36 and 38 of the tank body are taller than the side walls 32 and 34, and support the anode rods 14 and cathode bars 16 which span the length of the tank and extend through holes provided therein. The anode rods 14 are shown as round rods and the cathode bars 16 as rectangular bars, but each may be of any suitable cross-sectional configuration. Both are made of good conducting materials such as copper and are joined together at their ends by bars 42 and 44, respectively. The front and rear anode rods 14 rest on vertically extending ribs 46 and 48 which are disposed inside the tank body and are welded to the inside of walls 32 and 34 respectively. The primary purpose of these ribs is to strengthen the side-walls of the tank rather than to support the anode rods which have sufficient strength to span the length of the tank and carry the loads 59 placed upon them without any support. However, the weight of the load applied to the anode rods is transferred to the ribs 46 and 48, and tends to impart a moment thereto which is counter to the fluid load and serves to help support the sides of the tank body and resists the outward pressure of the fluid.

Connected to each-wall of the tank body are polypropylene brackets 50, 52 and 54. Note that the brackets 52 are positioned higher than the brackets 50 and lower than the brackets 54 (see FIG. 2). The hood sections 18, 20, 22 are secured to brackets by corrosion-resistant plastic or stainless steel screws. Each hood section covers an anode rod and is removable so that the anodes may be services and/or replaced, or the plating material hung from them may be replenished or changed from one material to another.

Figure 2:
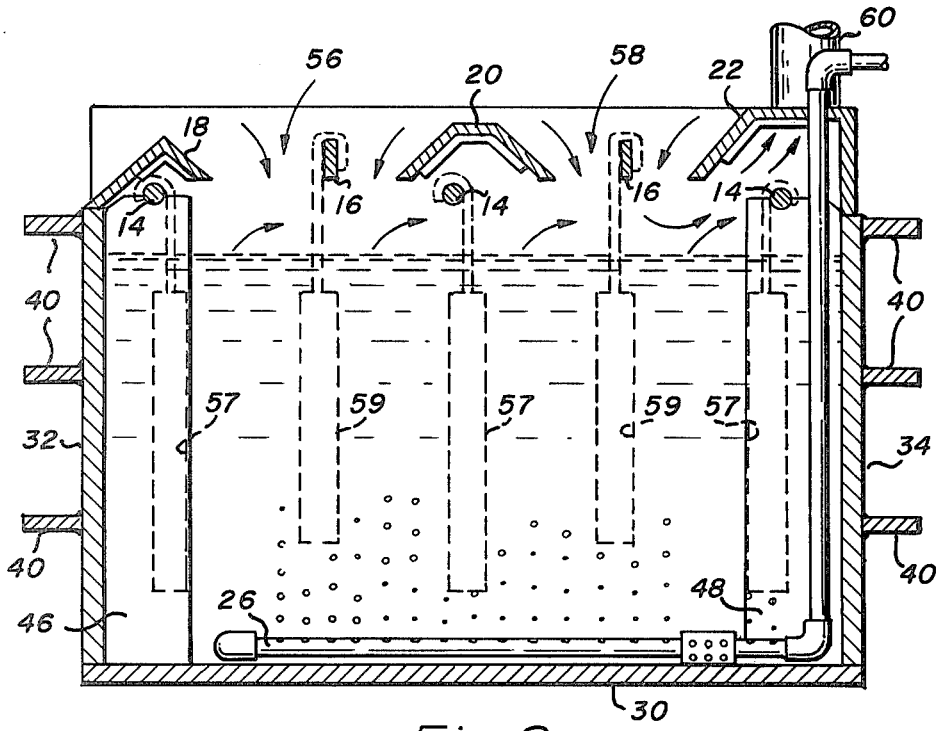
FIG. 2 is a cross-sectional view of the tank shown in FIG. 1 taken along line 2—2.
Figure 4:
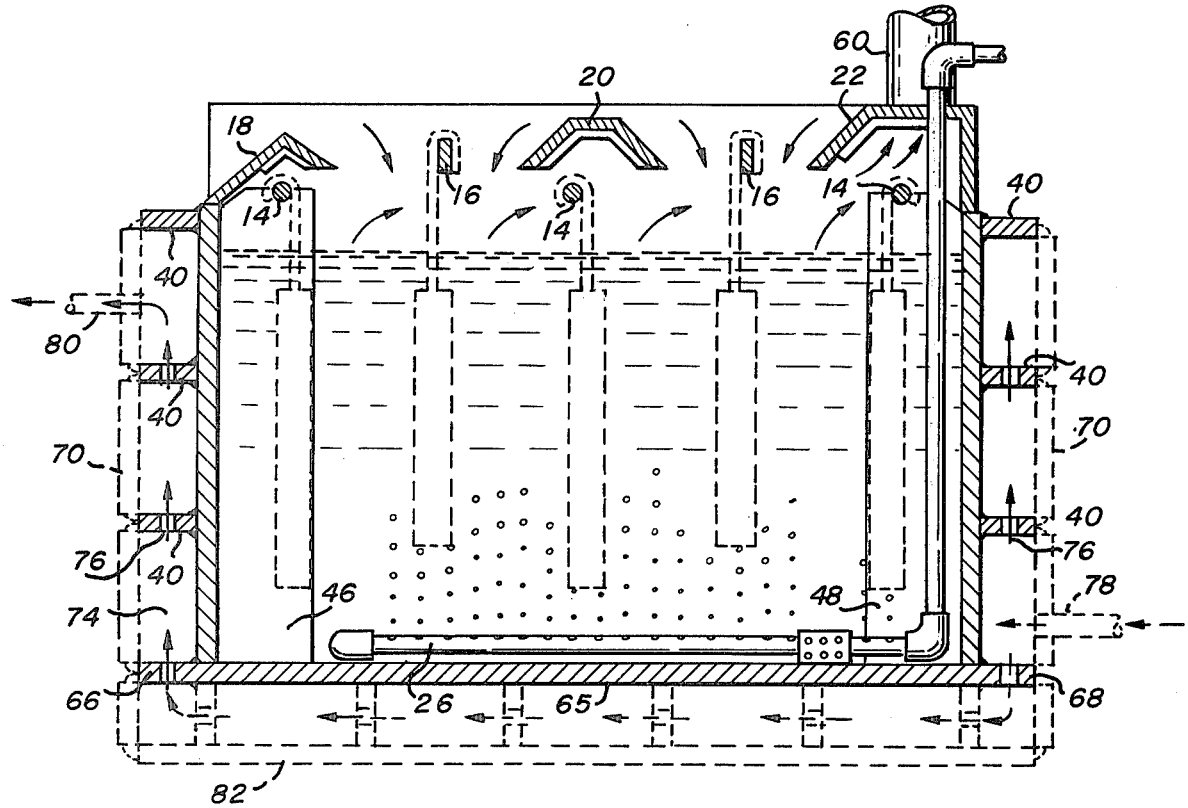
FIG. 4 is a cross-sectional view similar to that of FIG. 2 showing the addition of means forming an external jacket for heating the tank with hot water.
Figure 6:
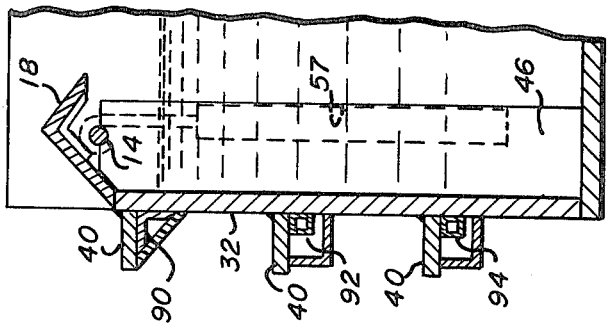
FIG. 6 is a partial cross-sectional view similar to the view shown in FIG. 2 showing the addition of circumscribing bands added to provide strength in larger embodiments.
Figure 3:
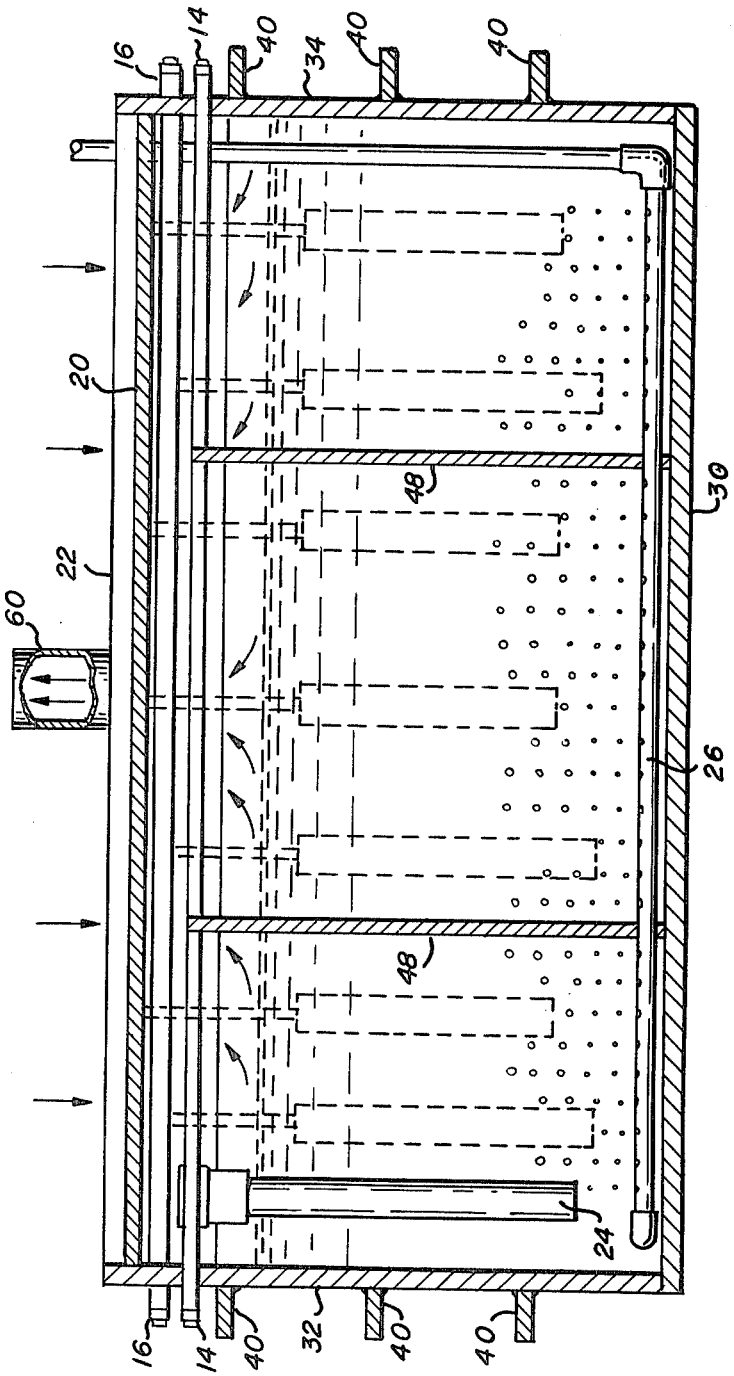
FIG. 3 is a cross-sectional view of the tank shown in FIG. 1 taken along line 3—3.

As illustrated in FIGS. 2, 3 and 4, plating material 57, such as solder or copper, etc., is hung on the anode rods by hooks and the articles to be plated 59 are hung by hooks on the cathode bars or are held in baskets or by other types of holders. The plating material and articles to be plated are immersed in an acid fluid contained in the tank.

As depicted in FIG. 2, the hood sections step up in height from near side to far side of the tank so that the top of hood section 18 is lowest and hood section 22 is highest. The stepped positioning of the hood is to make access easier when reaching across the tank to hang items on the cathode bars which are located in the openings 56 and 58 between the hood sections. Note that the hood portions defining the two tank openings 56 and 58 slope downward toward the openings. This is to reduce acid splashing as the plated items are removed and to cause drippage to run back into the tank.

The hood sections are stepped up so that the gas coming off the acid surface in the tank can rise naturally as it is drawn toward the ventilator outlet 60 which is secured to the top of the highest hood section 22. The hood sections help to confine the gas to a comparatively small open area more easily cleared by a ventilator in a fully open tank. Furthermore, the ventilator is fed by air being sucked down through openings in the spaces between the hood sections, and as a result the fumes are restrained from escaping through these openings. Arrows indicate the flow of inlet air and fumes from acid surface to the ventilator outlet 60.

Since most of the gas escaping from acid in the tank tends to hover low over the fluid surface and since a positive flow of air is induced through the openings 56 and 58, the hood sections make the ventilator more effective in removing substantially all of the fumes. Thus, as compared to prior art venting apparatus, a lower energy consuming and less costly ventilator may be used and still achieve superior results.

The hood sections and ventilator also remove acid vapors caused by gas bubbled up through the acid in some electroplating processes. As best shown in FIG. 2, when gas is forced through holes in corrosive resistive plastic pipes 26 located on the bottom of the tank to speed up the electroplating process by agitating and circulating the fluid in the tank, the hood sections put a cap on the rise of the acid vapor near the anodes, and air sucked down between the openings in the hood sections draws the acid vapor down and out through the ventilator.

As mentioned above, the hood sections and ventilator also limit splash when articles to be plated (59) are loaded and unloaded to/from the tank. When plated articles are removed from the tank, they are normally held above the tank for a short time to let most of the acid drip off of them. In accordance with the present invention, drops dripping from articles and hitting an inclined surface of a hood section bounce off in a downward direction toward one of the openings. Bounce back or splash of drops hitting the fluid in the tank or cathodes is also restrained by the hood and the downward motion of air passing through the open spaces between hood sections.

FIG. 1 shows a conventional immersion heater 24 of the type used in most electroplating tanks. This heater consists of a heating element encased in a corrosive resistant cylinder. In some electroplating applications the heater is used merely to keep the acid from dropping below room temperature (approximately 70° F.). However, in other electroplating applications, the temperature of the fluid must be raised to temperatures higher than room temperature. In such cases, if the fluid level drops below the hot part of the heater cylinder, acid gas mixed with air can ignite causing fire.

In FIG. 4 of the drawing, an alternative heating means for overcoming this hazard and reducing the costs of heating the fluid is shown. In this embodiment, the bottom sheet 65 is enlarged all around as indicated at 66 and 68, and extra side plates 70 are secured to the ribs 40 to provide circumscribing water-tight compartments 72 and 74 which surround the sides of the tank. Openings 76 are made in the lower rib 41 to permit hot water to circulate from the lower compartment to the upper compartment. Hot water is supplied to the lower compartment through an inlet 78 and the water circulates through the compartments and exits through an outlet 80 whereafter it is recirculated through a hot water heater.

For large tanks or higher temperature applications, the side jacket configuration may not provide adequate heat transfer to keep the fluid at the desired temperature. The needed additional heat transfer may be gained by adding additional water flow compartments below the bottom of the tank as shown by the dashed lines 82.

Where the size of the tank requires additional strength, and angle iron band and/or 2×2 or 2×3 inch metal tubing 92 and 94 may be positioned beneath the ribs 40 in circumscribing relationship to the tank. In order to protect against corrosion, the bands are sealed into circumscribing triangular or rectangular compartments formed of the same material used to fabricate the tank.

Although the present invention has been described above in terms of presently preferred embodiments, it is to be understood that such disclosure is by way of example only and is not intended to be considered as limiting. Accordingly, it is intended that the appended claims are to be interpreted as covering all alterations and modifications as fall within the true spirit and scope of the invention.

What is claimed is:

1. A ventilated electroplating tank for containing caustic liquids, comprising:

bottom and wall means forming a container which is open at the top;

first, second and third anode means disposed in parallel relationship to each other and extending across the top of said container;

first and second cathode means disposed in parallel relationship to each other and extending across the top of said container, said first cathode means being positioned between said first and second anode means, and said second cathode means being positioned between said second and third anode means;

hood means disposed across the top of said container so as to provide partial closure thereof, and defining a first opening over said first cathode means and a second opening over said second cathode means, said hood means having a ventilating port provided in a portion thereof through which gases developed within said container may be withdrawn.

2. A ventilated electroplating tank as recited in claim 1 wherein the portions of said hood means immediately adjacent said openings are sloped downwardly toward their respective adjacent openings.

3. A ventilated electroplating tank as recited in claim 1 wherein said hood means is comprised of first, second and third component parts respectively disposed above said first, second and third anode means.

4. A ventilated electroplating tank as recited in claim 3 wherein said third component part is disposed higher than said second component part, said second component part is disposed higher than said first component part, and wherein said ventilating port is provided in said third component part.

5. A ventilated electroplating tank as recited in claim 1 wherein said bottom and wall means are made of polypropylene.

6. A ventilated electroplating tank as recited in claims 1, 2, 3, 4 or 5 and further comprising girding band means made of the same material as said bottom and side-wall means and circumscribing said wall means to provide additional strength thereto.

7. A ventilated electroplating tank as recited in claim 6 and further comprising vertically extending rib means affixed to the interior surfaces of said wall means for strengthening said wall means.

8. A ventilated electroplating tank as recited in claim 7 wherein said first and third anode means bear upon interior portions of underlying ones of said rib means so as to impart moment forces thereto tending to counter any tendency of the adjacent walls to bow outwardly as a result of forces caused by liquids contained therein.

9. A ventilated electroplating tank as recited in claim 1 wherein said container is rectangular in configuration and is made of a plurality of flat sheets of inert material bonded together at their junctions.

10. A ventilated electroplating tank as recited in claim 9 and further comprising girding band means including portions made of the same material as said bottom and side-wall means and circumscribing said wall means to provide additional strength thereto.

11. A ventilated electroplating tank as recited in claim 10 wherein said band means further include rigid metal members enclosed within sealed, circumscribing compartments made of said same material.

12. A ventilated electroplating tank as recited in claims 1, 2, 3, 4, 9, 10 or 11 and further comprising means forming fluid heating jacket means disposed about a lower portion of said container for adding heat to fluids disposed within said container.

* * * * *